US005177369A

United States Patent [19]

Kamiya et al.

[11] Patent Number: 5,177,369

[45] Date of Patent: Jan. 5, 1993

[54] ENGINE OPERATING CONDITION DETECTOR AND CONTROL FOR ASSOCIATED ELECTRICAL SUPPLY SYSTEM

[75] Inventors: Tsuyoshi Kamiya; Hironori Nakayama, both of Iwata, Japan

[73] Assignee: Yamaha Hatsudoki Kabushiki Kaisha, Shizuoka, Japan

[21] Appl. No.: 887,659

[22] Filed: May 26, 1992

Related U.S. Application Data

[63] Continuation of Ser. No. 675,340, Mar. 26, 1991, abandoned.

[30] Foreign Application Priority Data

Mar. 30, 1990 [JP] Japan ..... 2-86722

[51] Int. Cl.[5] ..... F02D 45/00

[52] U.S. Cl. ..... 290/40 A; 290/1 R; 290/1 A; 290/37 R; 290/38 C; 290/38 E; 290/40 R

[58] Field of Search ..... 290/1 R, 1 A, 38 R, 290/38 C, 38 E, 40 R, 40 A

[56] References Cited

U.S. PATENT DOCUMENTS 4,231,073 10/1980 Suchko ..... 290/37 R
4,286,683 9/1981 Zeigner et al. ..... 290/38 E
4,520,271 5/1985 Goertler et al. ..... 290/38 C

*Primary Examiner*—A. D. Pellinen
*Assistant Examiner*—Robert Lloyd Hoover
*Attorney, Agent, or Firm*—Bacon & Thomas

[57] ABSTRACT

Engine-driven equipment includes a stopped-engine detector and a mechanism for safely shutting down the engine, including battery operated auxiliary devices, after detection that the engine has stopped. The engine may be shut down simply by closing a gas cock in the fuel line, but whatever the cause of engine stoppage, auxiliary devices are permitted to run for a predetermined time after stoppage to, for example, cool the engine or maintain warm glow plugs for easier restarting. If the gas cock is used to stop the engine, the engine will continue to run until fuel remaining in the fuel line has been expended, and then safely and automatically shut-down.

13 Claims, 3 Drawing Sheets

ENGINE OPERATING CONDITION DETECTOR AND CONTROL FOR ASSOCIATED ELECTRICAL SUPPLY SYSTEM

This application is a continuation of application Ser. No. 07/675,340, filed Mar. 26, 1991, now abandoned.

BACKGROUND OF THE INVENTION

1. Field of the Invention

This invention relates to engine-driven equipment, for example, an engine-driven electric generator, and more particularly to an improvement in electrical circuitry and fuel supply systems therefor which avoids fuel and battery energy wastage.

2. Description of Related Art

In engine-driven electric generators, compressed gas is generally used as the fuel for driving the generator unit. In addition, a battery is often used to facilitate starting of the engine. In such gas powered generators, auxiliary equipment such as electrically operated cooling fans for preventing the generator unit from overheating and electrically operated lubricating pumps to pump lubricating oil to the gas engine are required.

In general, stopping such a compressed gas powered engine involves interrupting the electrical circuit to the glow plugs by throwing a main switch to halt the flow of electricity to the glow plugs. When the engine is stopped due to lack of fuel or some other cause before the main switch has been thrown to cut power to the engine, the generator stops generating electricity but the electrical circuits remain closed and the above auxiliary equipment continues to run off of battery power. Because many types of engine-driven equipment are allowed to run unattended, the auxiliary equipment may end up operating for a long period of time even after the engine has been turned off. This results in a disadvantageous running down of the battery.

In the case of certain auxiliary devices which consume a great deal of electrical power, such as illumination devices, the engine-driven generator supplies electricity to both the equipment and the battery in a so-called free battery charging system. If the engine stops as described above, then power is supplied only from the battery, which then runs down especially rapidly.

Furthermore, in addition to the problem of battery energy wastage when the engine stops without throwing the main switch, a different problem arises when the engine is turned off using the main switch. The engine shut-off using the main switch causes engine fuel remaining within the fuel lines to back up and be expelled, thereby wasting engine fuel.

SUMMARY OF THE INVENTION

It is an objective of the invention to overcome the above-described problems by providing engine-driven equipment which avoids wasteful consumption of batteries and fuel.

In a preferred embodiment of the invention, this objective is accomplished by providing an engine-driven generator and auxiliary battery system having a stopped-engine detector and a mechanism for opening electrical circuits to the engine after the detector has issued a stopped-engine signal, even when the main switch has not been thrown. Thus, when the engine stops running for any reason other than being intentionally turned off by throwing the main switch, the power supply to the auxiliary equipment is also eventually stopped, preventing depletion of the battery by the auxiliary equipment.

In an especially preferred embodiment of the invention, power to the auxiliary devices is maintained for a predetermined time after engine stoppage in order to safely shut down all engine systems.

The engine-stopped condition is indicated by zero engine revolutions or an engine speed so low that the capacity of the generator to generate electricity is below the level needed to operate the above-described auxiliary equipment. These conditions may be detected by sensing the terminal voltage of the generator or the engine speed. If the terminal voltage is used, then the output voltage of the generator may be measured to determine whether the output is sufficient to power the electric auxiliary equipment. Methods of directly detecting engine speed which use a pickup coil, or employ the ignition signal to detect the ignition spark, make possible a determination as to whether the engine has stopped or whether it is operating below a certain speed.

Finally, in the preferred embodiment of the invention, stopped-engine detection is used to close the fuel line and thus avoid wastage of fuel left therein.

DETAILED DESCRIPTION OF THE PREFERRED EMBODIMENTS

Figure 1:
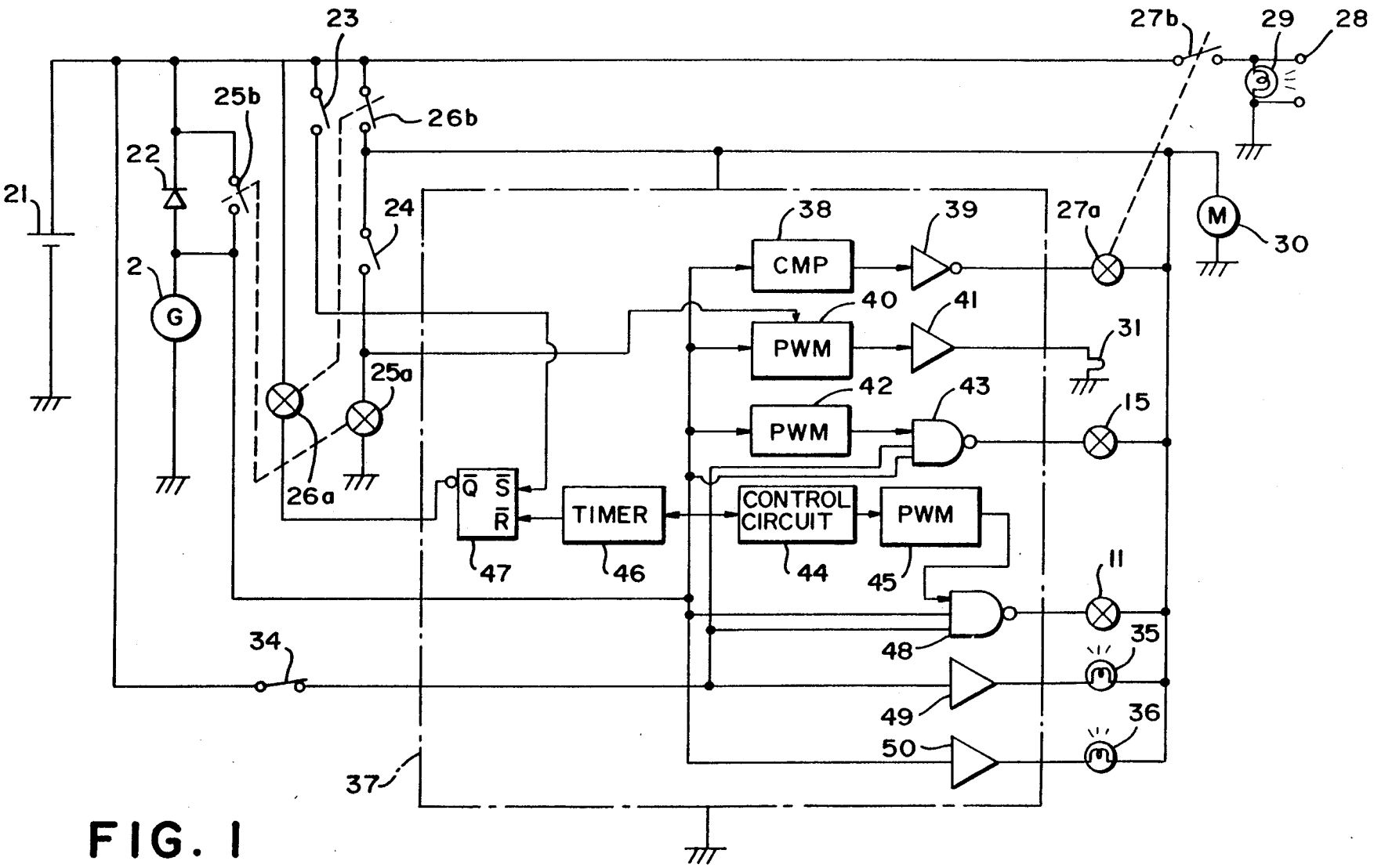
FIG. 1 is an electrical circuit diagram of a stopped-engine detection and control circuit for an engine-driven electric generator according to a preferred embodiment of the invention.
Figure 2:
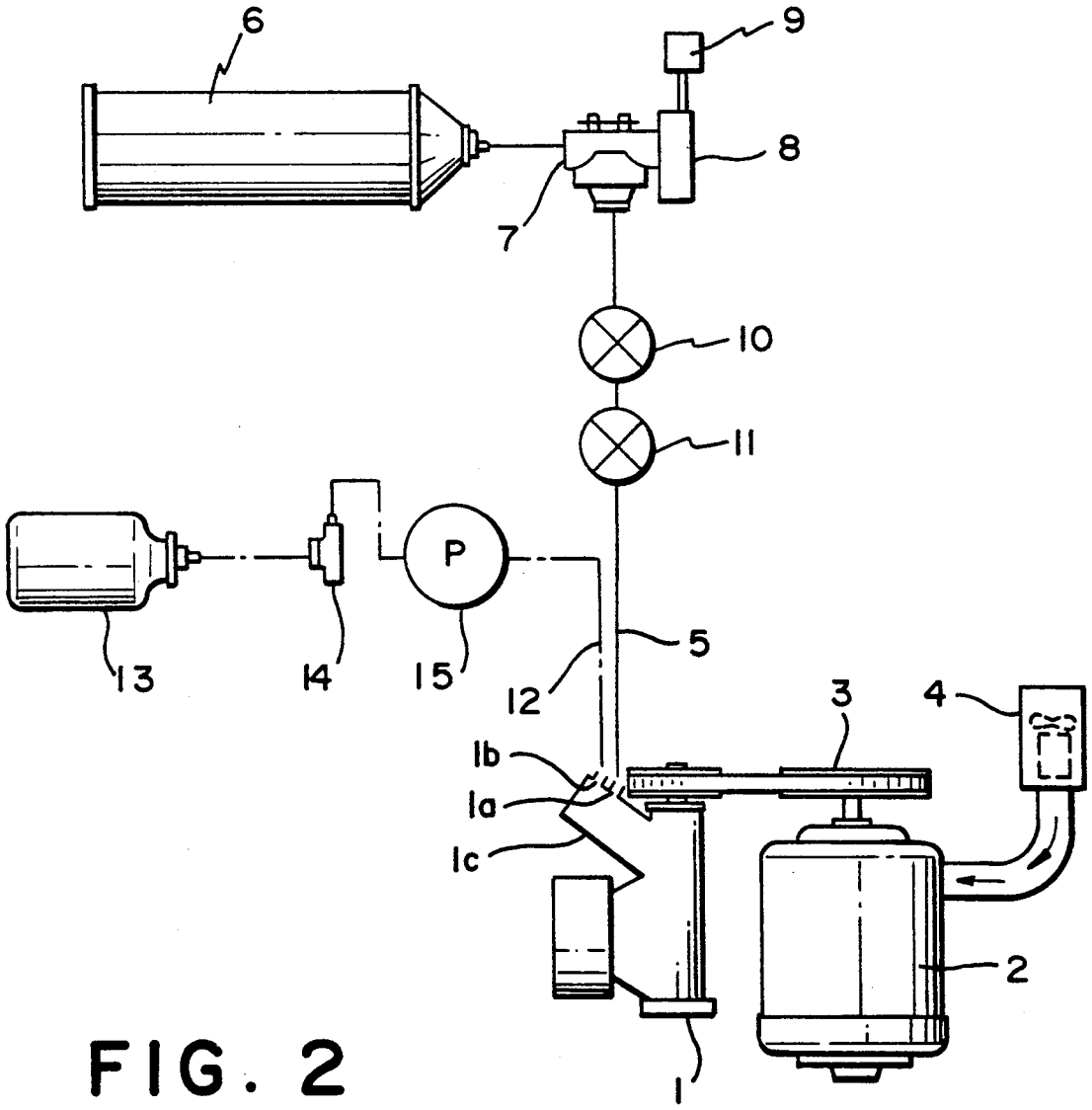
FIG. 2 is a schematic diagram of a water-cooled two-cycle gas engine for use with the electrical circuit of FIG. 1.
Figure 3:
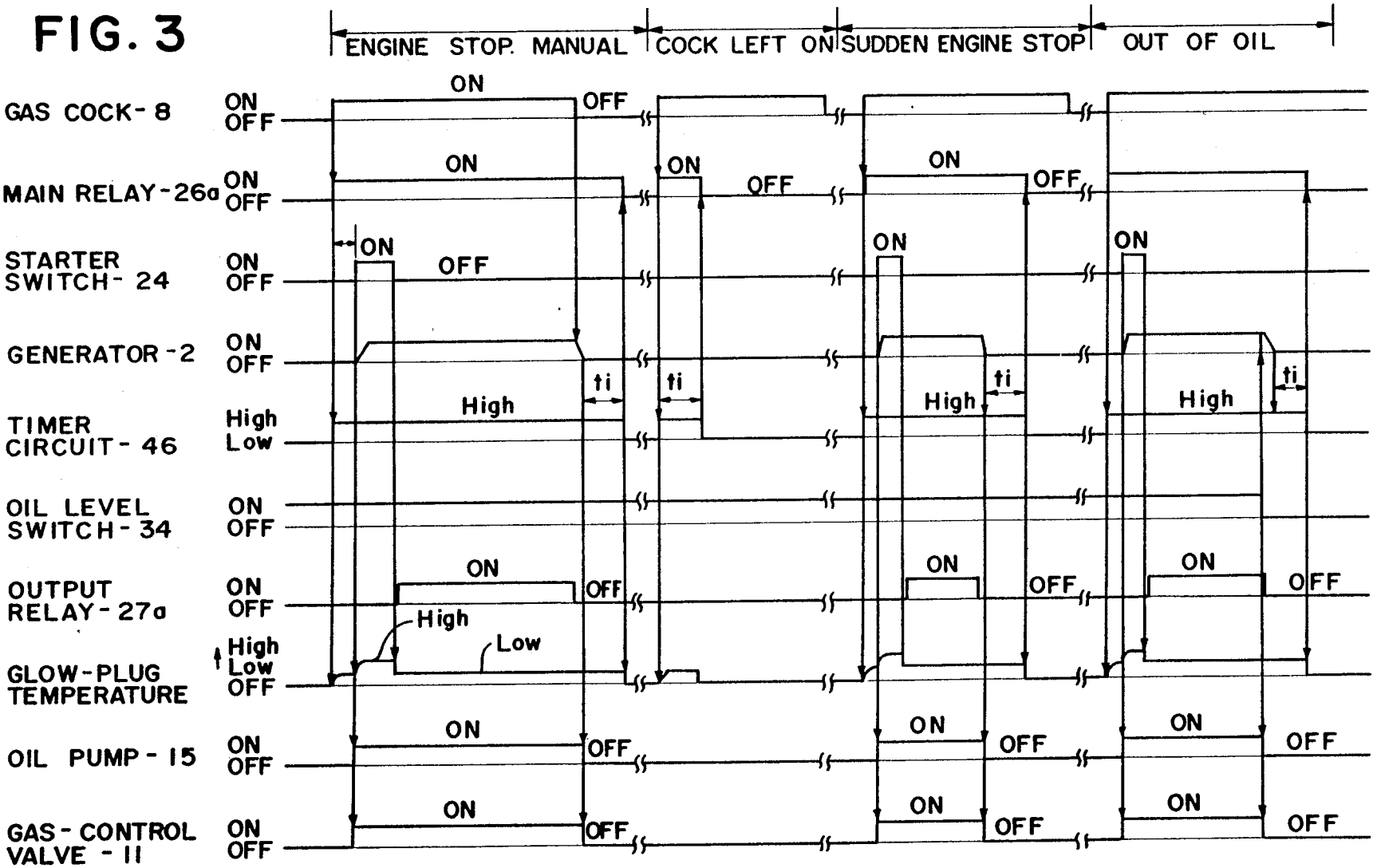
FIG. 3 is a flowchart describing operation of the electrical circuit of FIG. 1.

FIGS. 1-3 show a preferred embodiment of the invention which will be described in the context of an engine-driven electric generator. FIG. 1 is an electrical circuit diagram, FIG. 2 shows the general structure of the equipment, and FIG. 3 is a flowchart describing its operation.

In FIG. 2, which shows the general design of an engine-driven generator, reference numeral 1 denotes a water-cooled two-cycle compressed gas engine, and reference numeral 2 denotes a combination starter/DC generator which is linked to the gas engine 1 by drive belt 3. During start-up, battery 21 shown in FIG. 1 starts the engine 1 through starter/generator 2. After the engine is started, engine 1 drives generator unit 2 to generate electricity. A portion of this generated electricity goes to charge battery 21, while the remaining and major portion is output through output terminals 28 for external uses. Electric fan 4 cools the generator and is driven by battery 21.

A fuel line 5 opens at one end into fuel intake 1*a* of carburetor 1*c* and at its other end into gas tank 6. Fuel line 5 also includes a pressure regulator 7, an engine-stopping electromagnetic valve 10, and a gas flow regulating valve 11. Pressure regulator 7 includes a gas or fuel cock 8 and a knob 9 for the cock.

Oil line 12 for lubricating oil opens into opening 1*b* in carburetor 1*c* and connects to oil tank 13 via one-way valve 14 and oil pump 15.

As shown in FIG. 1, battery 21 is connected to diode 22 which prevents electricity from flowing from the battery to the generator unit 2. Gas cock switch 23 opens gas cock 8 when knob 9 is in an ON position, and starter switch 24 starts the engine when it is in an ON or closed position. During engine starting, starter relay coil 25*a* and switch 25*b* are also ON, i.e., closed.

Main relay coil 26 and switch 26*b* form a mechanism for opening the electrical circuit after stopping of the engine, and therefore must be closed during starting and normal operation. Output relay coil 27*a* and output relay switch 27*b*, on the other hand, are ON whenever the voltage from generator 2 is above a certain level, as indicated by an output lamp 29, and therefore constitute a voltage sensing device whose output is effectively a stopped-engine signal. Fan motor 30 drives cooling fan 4. Oil-level switch 34 closes when the remaining amount of oil is above a certain level to light indicator lamp 35 via amplifier 49.

Reference numeral 31 denotes a glow plug and 36 a starter indicator lamp. Control unit 37 controls the flow of electricity to output relay coil 27*a*, glow plug 31, and so forth. Comparator 38 and inverting amplifier 39 energize output relay coil 27*a* when the generator voltage from generator 2 is above a predetermined level, while voltage control circuit 40 and amplifier 41 regulate the voltage to glow plug 31. Voltage control circuit 42 and AND circuit 43 control the supply of electricity to oil pump 15. PI control circuit 44, voltage regulator circuit 45, and AND circuit 48 control the opening time for gas flow regulator valve 11 in order to keep the generated voltage constant. Amplifier 50 controls the electricity supplied to starter indicator lamp 36.

Finally, timer circuit 46 and flip-flop 47 energize main relay coil 26*a* to close relay 26*b* when the output from timer circuit 46 is high and when the above-described gas cock switch is ON. After a predetermined time, the output of timer circuit 46 switches to low, opening switch 26*b* and shutting off the supply of electricity to fan 30.

The circuit shown in FIG. 1 operates as follows: When gas cock switch 23 is on, gas cock 8 opens and the output from flip-flop 47 is low. The main relay coil 26*a* is energized to turn on main relay switch 26*b* and close the electrical circuit. This causes fan motor to turn on cooling fan 4. At this time, timer circuit 46 switches to a high level, electricity starts flowing to glow plug 31 and starter indicator lamp 36 lights up to indicate that the starter button may be pressed.

When the starter button is pressed, and starter switch 24 is thereby turned on, starter relay coil 25*a* is energized so that starter relay switch 25*b* switches on. Oil pump 15 and gas flow regulator valve 11 are turned on while glow plug 31 maintains its high temperature, and the starter/generator 2 begins cranking the engine 1.

When the engine 1 starts, generator 2 begins generating electricity. When the voltage rises above a certain level, output relay coil 27*a* is energized to switch on output relay switch 27*b*, lighting output lamp 29 and causing generated current to be present at output terminal 28. At this time, glow plug 31 maintains a lower temperature.

When gas cock 8 is manually closed via knob 9 during normal operations, however, the engine continues running until the gas remaining in the fuel line 5 is depleted, after which the engine stops, as shown in FIG. 3, thus reducing fuel wastage. In this case, closing of gas cock 8 turns gas cock switch 23 off. When electricity generation stops, and the drop in terminal voltage is detected, output relay switch 27*b* also turns off, and oil pump 15 and gas control valve 11 are turned off. After a time $t_1$ has elapsed beyond the cessation of generation, timer circuit 46 goes low and this halts excitation of main relay coil 26*a* turning main relay switch 26*b* off, stopping fan motor 30 and halting electricity flowing to glow plug 31.

If, during the above-described start-up procedure, gas cock 8 is opened but the start button is not pressed to turn on starter switch 24 as shown in FIG. 3 ("cock left ON"), then after a predetermined period of time has elapsed, timer circuit 46 goes low, turning off main relay switch 26*b* and halting operation of fan motor 30 just as if the above-mentioned gas cock had been closed. In this situation, output relay 27*a* is not activated to close switch 27*b*, glow plug 31 reaches a low temperature but is only shut off after time $t_1$, has elapsed, and oil pump 15 and gas-control valve 11 remain in a deactivated state.

If for some other reason, engine 1 stops running ("sudden engine stop"), after a predetermined period of time $t_1$ has elapsed from the cessation of electricity generation, main relay switch 26*b* will again turn off, stopping fan motor 30, a shown in FIG. 3. Also, output relay 27*a*, oil pump 15, and gas-control valve 11 which had all been activated during normal operation of the generator are all switched off immediately after the drop in terminal voltage is detected, as was the case in the manual engine stop situation. On the other hand, glow plug 31 maintains a low temperature until time $t_1$, has elapsed.

Finally, if the lubricating oil is depleted, as shown in FIG. 3, turning the oil switch 34 to off causes the oil pump 15 and the gas control valve 11 to shut down, and in addition, after the predetermined period of time $t_1$ has elapsed from the cessation of generation, main relay switch 26*b* switches off, halting operation of fan motor 30. Glow plug 31 again maintains a low temperature until time $t_1$ has elapsed.

Therefore, in this example of an electric generator, if engine 1 stops for any reason whatsoever and electricity generation stops, then after a predetermined period of time $t_1$ has elapsed, main relay switch 26*b* will switch off as a result of deactivation of relay coil 26*a*, opening the circuit for fan motor 30 and avoiding depletion of battery 30 through continued operation of the fan motor. Nevertheless, during the predetermined period of time elapsing from the engine stoppage, before timer circuit 46 goes low and main relay switch 26*b* is switched off halting the fan motor 30, cooling action proceeds. Since the glow plug 31 is maintained at a low temperature while the above-mentioned timer circuit is operating, restarting the engine is a simple matter.

Also, since the preferred embodiment makes it possible to stop the engine 1 by closing gas cock 8, all of the fuel in fuel line 5 contributes to the generation of electricity and is not wasted.

The above description uses a fan motor 30 as an example of auxiliary equipment which is operated for a predetermined time after engine stoppage and then shut down so as to prevent wastage of battery energy, but of course this invention is not limited to equipment having fan motors. It can be applied to other auxiliary equipment and to equipment other than the exemplary engine-driven generator. It will of course be appreciated that various different kinds of indicator displays may be used in this arrangement.

Because the above-described invention may be used in numerous contexts, and because numerous variations will undoubtedly occur to those skilled in the art, it will be appreciated that the above description should be taken solely by way of example, and that the scope of the invention is intended to be limited only by the appended claims.

I claim:

1. Engine-driven equipment of the type including an engine, a generator driven by the engine, and a battery, and comprising:

a generator output terminal to which said battery and said generator are connected via a switch;

stopped-engine detection means for detecting that the engine has stopped and thereafter issuing a stopped-engine signal; and electric circuit opening means for opening at least said switch by means of the stopped-engine signal issued by said detection means.

2. Apparatus as claimed in claim 1, wherein said stopped-engine detection means is responsive to means for detecting the voltage output of said generator and issuing a stopped-engine signal when the voltage output of said generator is below a predetermined level.

3. Apparatus as claimed in claim 1, wherein said electric circuit opening means includes a timing circuit for opening said switch a predetermined period of time after said engine has stopped.

4. Apparatus as claimed in claim 1, wherein said equipment further includes auxiliary equipment driven by the battery, said battery being charged by said generator, and switch means for enabling said battery to continue to be charged by said generator after said fuel line has been manually closed, until fuel remaining in said fuel line is used up, after which said electrical circuit opening means opens said switch means, shutting off said auxiliary equipment and preventing excessive discharging of said battery.

5. Apparatus as claimed in claim 1, wherein said equipment includes a glow plug, means for energizing said glow plug to a high temperature during starting and to a lower temperature thereafter, and means for causing said electric circuit opening means to turn off said glow plug a predetermined time after said detection means has issued the stopped-engine signal.

6. Apparatus as claimed in claim 1, wherein said equipment includes an oil pump and said electric circuit opening means includes means for turning off said oil pump when said engine has stopped.

7. Apparatus as claimed in claim 1, wherein said equipment includes a gas flow regulator valve and said electric circuit opening means includes means for closing said valve when said engine has stopped.

8. Apparatus as claimed in claim 1, wherein said stopped-engine detection means comprises a relay connected to and energized by the output of said generator, and said electric circuit opening means comprises means for causing said relay to close said switch when said engine is operating and to open said switch when said engine has stopped.

9. Apparatus as claimed in claim 8, further comprising a second relay connected to a second switch connected between said battery and an auxiliary device, and said electric circuit opening means further comprises means for causing said second relay to open said second switch a predetermined time after said first relay has opened said first switch.

10. Apparatus as claimed in claim 9, wherein said second relay is switched on when a flip-flop connected thereto is in a set state, and switched off when said flip-flop is reset by the output of a timer, the set input of said flip-flop being connected to a manually activated switch which turns on and off a fuel cock for supplying fuel to said engine.

11. Apparatus as claimed in claim 10, further comprising means including a third relay for opening a third switch connected in series between said generator and a generator output terminal.

12. Apparatus as claimed in claim 9, further comprising means including a third relay for opening a third switch connected in series between said generator and a generator output terminal.

13. Engine-driven equipment of the type including an engine and a battery, and comprising:

stopped-engine detection means for detecting that the engine has stopped and thereafter issuing a stopped-engine signal;

electric circuit opening means for opening electrical circuits by means of the stopped-engine signal issued by said detection means;

main switch means for turning off said engine when thrown; and means for causing said engine to continue operating until fuel remaining in the fuel line has been expended after said main switch means has been thrown.

* * * * *